US011583872B2

(12) United States Patent
Hong

(10) Patent No.: US 11,583,872 B2
(45) **Date of Patent: *Feb. 21, 2023**

(54) SHOWERHEAD ENGINE FOR ROTATING SPRAY

(71) Applicant: Spectrum Brands, Inc., Middleton, WI (US)

(72) Inventor: Zachary Keoki Hong, Irvine, CA (US)

(73) Assignee: Spectrum Brands, Inc., Middleton, WI (US)

( * ) Notice: Subject to any disclaimer, the term of this patent is extended or adjusted under 35 U.S.C. 154(b) by 123 days.

This patent is subject to a terminal disclaimer.

(21) Appl. No.: 16/677,925

(22) Filed: Nov. 8, 2019

(65) Prior Publication Data

US 2020/0139386 A1 May 7, 2020

Related U.S. Application Data

(63) Continuation of application No. 15/728,470, filed on Oct. 9, 2017, now Pat. No. 10,471,444.

(60) Provisional application No. 62/405,504, filed on Oct. 7, 2016.

(51) Int. Cl.
*B05B 3/04* (2006.01)
*B05B 1/18* (2006.01)

(52) U.S. Cl.
CPC ..... *B05B 3/04* (2013.01); *B05B 1/18* (2013.01); *B05B 3/0418* (2013.01)

(58) Field of Classification Search
CPC ..... B05B 1/083; B05B 1/18; B05B 1/185; B05B 1/34; B05B 1/3405; B05B 3/04; B05B 3/0409; B05B 3/0418; B05B 3/0422; B05B 3/0427; B05B 3/0486; B05B 3/0495
See application file for complete search history.

(56) References Cited

U.S. PATENT DOCUMENTS 3,485,451 A * 12/1969 Gore ..... B05B 3/0427 239/383
3,762,648 A 10/1973 Deines et al.
4,204,646 A 5/1980 Shames et al.
4,254,914 A 3/1981 Shames et al.
6,648,245 B1 11/2003 Samwell et al.
(Continued)

FOREIGN PATENT DOCUMENTS

DE 102008015969 A1 9/2009
GB 2348615 A 10/2000

OTHER PUBLICATIONS

International Search Report and Written Opinion for PCT/US2017/055779, dated Jan. 23, 2018 (13 pgs).

*Primary Examiner* — Darren W Gorman
(74) *Attorney, Agent, or Firm* — Merchant & Gould P.C.

(57) ABSTRACT

A showerhead engine includes a first plate joined to a second plate with a cavity therebetween. Water enters the cavity through an angled hole in the first plate and flows in a swirling motion about the central axis. A paddle wheel is spun within the cavity by the swirling water. A notched cutout in the paddle wheel forms an exit passage through a through hole in the second plate allowing the water to exit when the notched cutout lines up with slots in the second plate. The revolving paddle wheel continues to revolve thereby revolving the notched cutout and producing a revolving spray pattern.

14 Claims, 13 Drawing Sheets

(56) References Cited

U.S. PATENT DOCUMENTS

| | | | | |
|---|---|---|---|---|
| 8,297,534 | B2 * | 10/2012 | Li | B05B 1/18 239/222.11 |
| 2011/0210189 | A1 | 9/2011 | Chen | |
| 2014/0008462 | A1 | 1/2014 | Gransow et al. | |
| 2017/0128963 | A1 * | 5/2017 | Lin | B05B 3/04 |

* cited by examiner

SHOWERHEAD ENGINE FOR ROTATING SPRAY

CROSS-REFERENCE TO RELATED APPLICATIONS

The present application is a continuation of U.S. patent application Ser. No. 15/728,470, filed Oct. 9, 2017, now U.S. Pat. No. 10,471,444; which claims priority from U.S. Provisional Patent Application No. 62/405,504, filed on Oct. 7, 2016, the disclosures of which are hereby incorporated by reference in their entireties.

TECHNICAL FIELD

This invention relates to the field of showerheads. In particular, the invention relates to a dynamic showerhead engine that produces a moving pattern of water.

BACKGROUND OF THE INVENTION

Showerhead engines are used to provide a unique showering experience. Showerhead engines may be configured to produce a wide array of spray patterns and features. For example, many showerhead engines are designed to minimize water consumption. Water consumption is typically minimized with introduction of an orifice restrictor in the water inlet path or the outlet.

A known issue with restricting the water inlet is that a longer shower is needed to thoroughly wet and rinse an area. This increased time in the shower duration is perceived as a great inconvenience to the user.

A known issue with restricting the water outlet is that the water droplets formed are very small, thereby losing thermal energy in the process due to the increased surface area of the fine droplets and contact with the surrounding air.

Yet another known issue with showerhead engines is that many small parts are required, thereby increasing the mechanical complexity of the engine. This increased complexity increases the cost and the potential for a failure due to scale build-up or mechanical failure.

What is therefore needed is a showerhead engine that restricts water flow while providing a comparable shower experience as a higher flow rate showerhead. What is also needed is a showerhead engine that wets a similar area as a higher flow rate showerhead. Finally, what is needed is a showerhead engine that addresses the known issues without complex parts.

OBJECTS AND SUMMARY OF THE INVENTION

A showerhead engine includes a first plate with a face surface and a wall extending from the first plate. At least one hole is formed in the face surface of the first plate at an angle other than normal to the face surface. A ring may be formed around the central axis of the first plate by the plurality of holes, or a single hole may be formed in the face surface of the first plate.

The showerhead engine is configured to feed a water flow into the at least one hole. A second plate with a face surface and a wall extending from the second plate with a through hole formed at the center of the face surface of the second plate at a normal angle is joined to the first plate. The through hole includes a plurality of slots formed in the face surface of the second plate intersecting the through hole.

A cavity with a central axis is formed by the face surface and wall of the first plate joined at the walls to the face surface and wall of the second plate. A paddle wheel with a plurality of paddles, joined to a central shaft, is supported by and in between the first plate and the second plate. A recessed portion formed in the first plate at the central axis is configured to receive the shaft.

The shaft aligns with the central axis of the cavity and also passes through the through hole formed at the center of the face surface of the second plate. The shaft includes a notched cutout where the shaft passes through the hole in the center of the face plate of the second plate. The shaft also has a first shoulder supported by the first plate and a second shoulder supported by the second plate.

When water is passed through the at least one hole in the first plate, it enters the cavity in a swirling motion caused by the angle of the at least one hole. Within the cavity, the water continues to swirl, thereby pushing the paddles of the paddle wheel causing it and the shaft to rotate. The water then exits a portion of the through hole in the center of the face surface defined by the notched cutout. In other words, as the shaft rotates, water exits the portion of the through hole defined by the notched cutout overlapping one of the slots. Either a single or multiple slots may overlap the notched cutout at any given time. The notched cutout includes an angled surface configured to deflect the exiting water and change a direction of the water flow.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

The present disclosure relates generally to a showerhead engine and a showerhead incorporating such a showerhead engine. The showerhead engine of the present disclosure provides, in some embodiments, a simple design in which water flow is restricted while concurrently directing water flow to a large area. Such a showerhead engine and showerhead can, in such cases, increase user satisfaction and convenience, without requiring great mechanical complexity.

Figure 1:
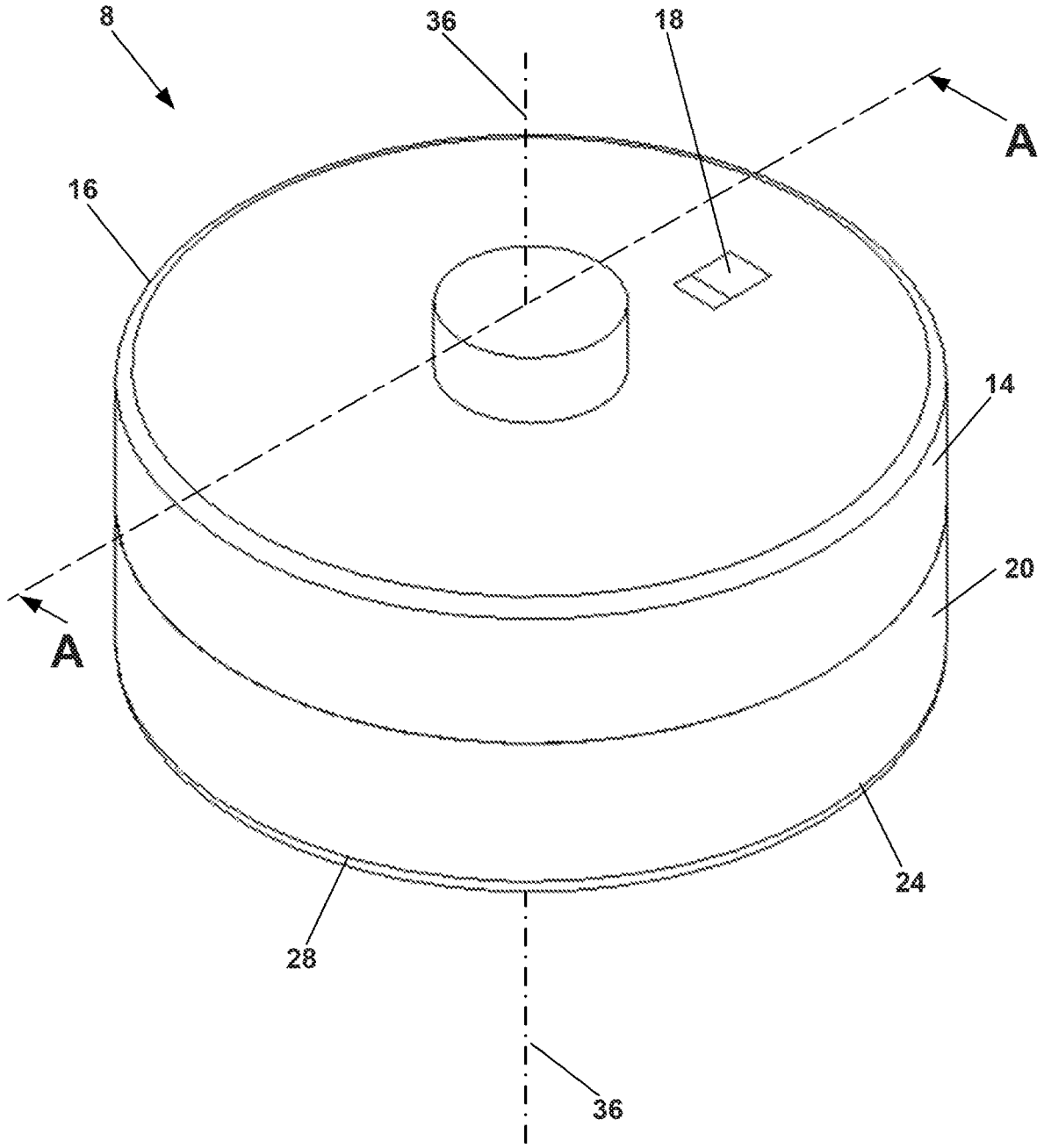
FIG. 1 shows a raised, perspective view of the showerhead engine according to an embodiment of the invention.
Figure 2:
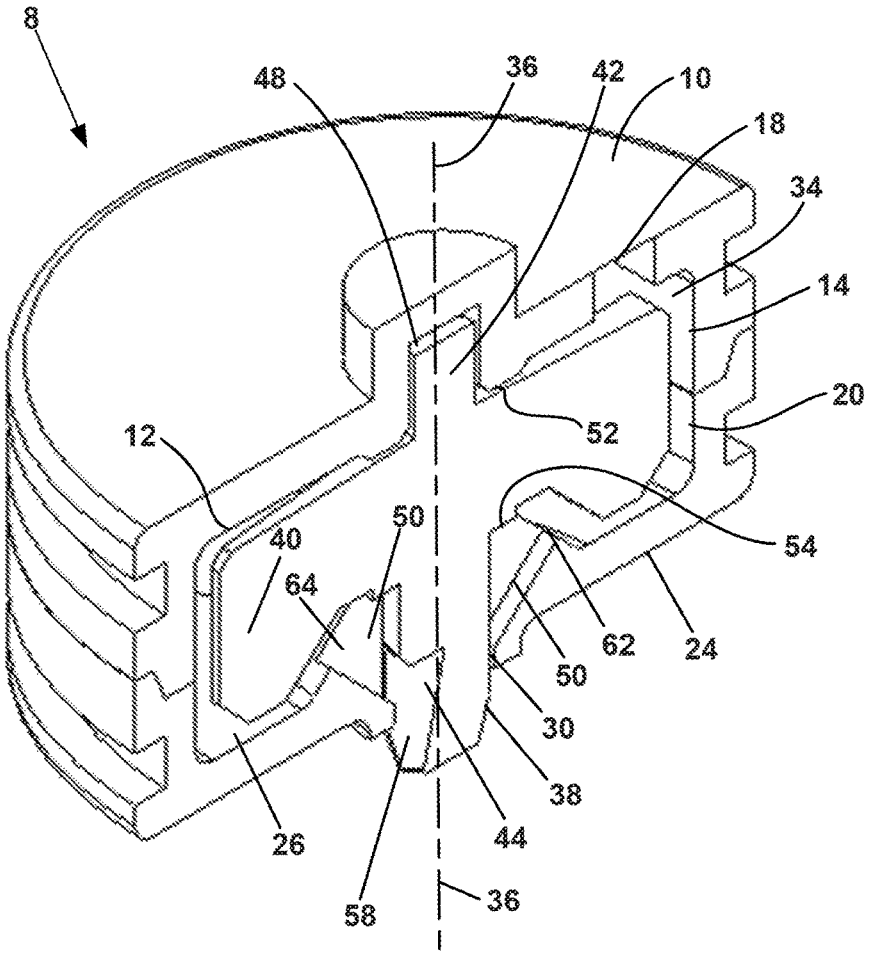
FIG. 2 shows a raised, perspective, cross-sectional view of the showerhead engine of FIG. 1 along line AA.

Referring first to FIGS. 1-7, a first embodiment of a showerhead engine 8 and showerhead 68 incorporating such a showerhead engine are shown. FIG. 1 shows the showerhead engine 8, within the context of an exploded view of a showerhead 68. The showerhead engine 8 is configured to be installed within or otherwise provided as part of a showerhead 68, as seen in FIGS. 1-2, and seen in further detail below in FIGS. 6 and 7. The showerhead engine includes a first plate 10 and a second plate 24 that are spaced apart from each other to form a perimeter of a cavity 34, discussed further below. In some embodiments, the first plate 10 and second plate 24 are joined together, e.g., at walls 14, 24 extending from the first plate 10 and second plate 24, respectively. The first plate 10 and second plate 24 are shown as having cylindrical and circular portions, but they may be formed in any other shape as well. Preferably, the shape has rounded internal edges as this promotes a swirling effect within the showerhead engine 8 when water is introduced through hole 18. While a single hole 18 is shown as being included for each showerhead engine 8, a plurality of holes 18 may also be formed into the first plate 10 for each showerhead engine 8. When multiple holes 18 are used, the holes 18 preferably form a ring about the central axis 36 of the showerhead engine 8, thereby promoting the swirling effect.

As previously mentioned, the first plate 10 includes a wall 14 extending from and defining a perimeter 16 of the showerhead engine 8 at the first plate 10. Similarly, the second plate 24 includes a wall 20 extending from and defining a lower perimeter 28 of the showerhead engine 8 at the second plate 24. The wall 14 of the first plate 10 is joined to the wall 20 of the second plate 24 thereby sealing the respective plates together.

Figure 3:
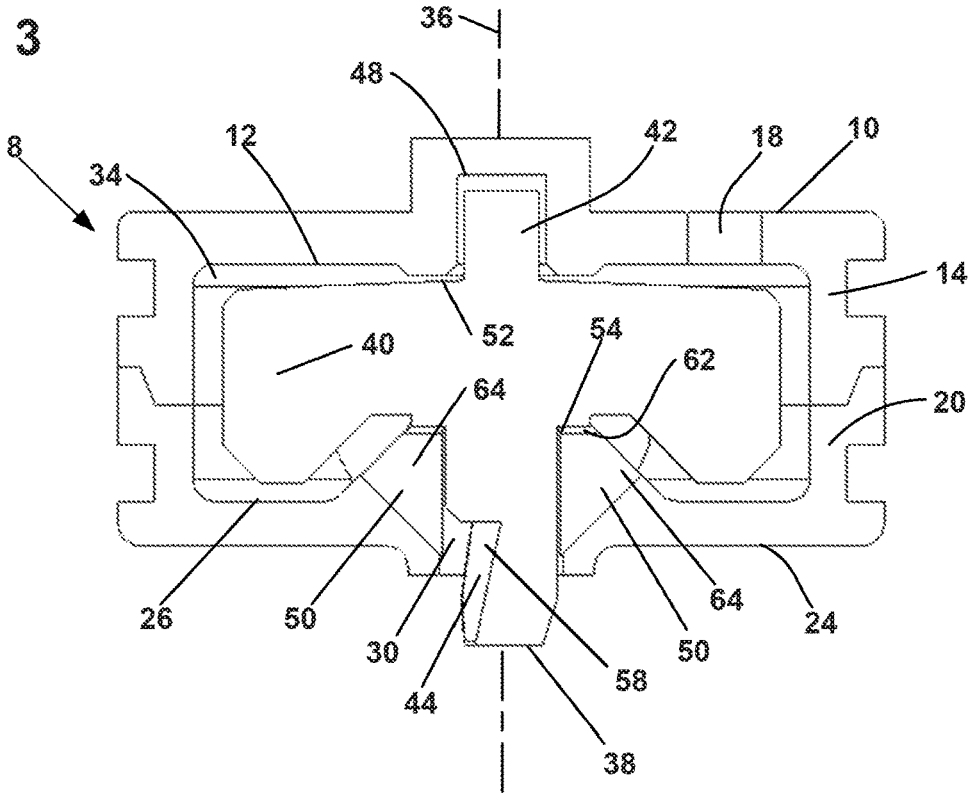
FIG. 3 shows a front, cross-sectional view of the showerhead engine of FIG. 1 along line AA.

Referring now to FIGS. 2 and 3, cross sectional views AA reveal a cavity 34 formed by joining the first plate 10 to the second plate 24. The respective walls extend to join one another to create the cavity 34. When water is introduced to the showerhead engine 8, the water may enter the hole 18 and fill the cavity 34. As the water is introduced into the cavity 34, it moves in a swirling pattern about the central axis 36. Each hole 18 has at least one surface that is formed at an angle other than normal to the face surface 12 of the first plate 10. In other words, each hole 18 is formed to include at least one angled surface extending through the first plate 10 and exposing an opening into the cavity 34 thereby urging the water to flow into the cavity at an angled (non-perpendicular) direction to the first plate 10. In the example embodiments shown, the angled surface has an angled direction in a rotational or axial direction of the generally rounded or circular interior volume of the showerhead engine, thereby promoting water entering the interior volume to rotate around the central axis 36. As a result, should multiple holes 18 be desired around the central axis 36, the angle of each hole 18 formed into the first plate 10 can be similarly oriented, thereby further promoting the continuous swirling flow pattern about the central axis 36.

In response to the swirling flow pattern being established within the cavity 34, the paddle wheel 38 rotates about the central axis 36 in the direction of the swirling flow pattern. Each individual paddle 40 receives a force from the swirling water, causing the paddle wheel 38 to rotate. The paddle wheel 38 is kept in place by a central shaft 42 in alignment with the central axis 36. The central shaft 42 is inserted into a recessed portion 48 in the face surface 12 of the first plate 10. A first shoulder 52 on the central shaft 42 abuts the face surface 12 of the first plate 10. Optionally, a shoulder engagement section 53 surrounding the recessed portion 48 extends slightly into the space between the first plate 10 and second plate 24 to engage the shoulder 52, thereby causing less than the entire top surface of the paddle wheel 38 to engage with the face surface 12, reducing friction during rotation of the paddle wheel 38. Similarly, a second shoulder 54 abuts a cone 62 extending from the face surface 26 of the second plate 24.

The individual paddles 40 are formed to complement the cavity 34 which maximizes the force transferred from the swirling water to the paddle wheel 38. Preferably, each paddle 40 is perpendicular with respect to the face surface 12 of the first plate 10 and the face surface 26 of the second plate 24. As a result, the paddle wheel does not rotate from any axial flow or curvature of the paddles 40, but it rotates from the circular flow about the central axis 36. It is foreseen that the paddles 40 may be modified to be angled with respect to the face surfaces 12, 26 at an angle other than normal within the scope of the present disclosure.

As can be understood from the above-described geometry of the showerhead engine 8, a unique spray pattern is created by the rotating paddle wheel 38. The central shaft 42 of the paddle wheel 38 includes a portion that extends from a through hole 30 formed in the face surface 26 of the second plate 24. The through hole 30 is formed in the center of the face surface 26 and creates an exit point for the swirling water within the cavity 34. After the water enters the cavity 34 through the hole 18, it can only exit the through hole 30. As the central shaft 42 of the paddle wheel 38 is inserted into the through hole 30, the water can only exit the portion of the through hole 30 defined by a notched cutout 44 in the central shaft 42.

The notched cutout 44 thereby creates a flow path for the water to exit the cavity 34. The notched cutout 44 is also preferably formed at an angle creating an angled surface 58 which is angled with respect to the central axis 36. As the water exits the through hole 30, it is deflected off of the notched cutout 44. The particular angle of the angled surface 58 can therefore be any desired angle to achieve the desired spray pattern. To further facilitate the unique spray pattern effect, a cone 62 extends from the face surface 26 of the second plate 24 within the cavity 34. The cone 62 includes a plurality of slots 50 through the cone 62 that create passages 64 for the water to enter the through hole 30. As the paddle wheel 38 rotates, the notched cutout 44 aligns with a slot 50 and thereby opens the passage 64 allowing for water to exit the through hole 30. Preferably, the notched cutout 44 aligns with at least one slot 50 at all times, which ensures a consistent stream of water exiting the through hole 30. It is envisioned that the slots 50 could be spaced about the cone 62 so there is only an intermittent alignment between the notched cutout 44 and a slot 50, which would produce a pulsed spray pattern; the water flow would be cut off when the notched cutout 44 did not align with any slots 50.

Figure 4:
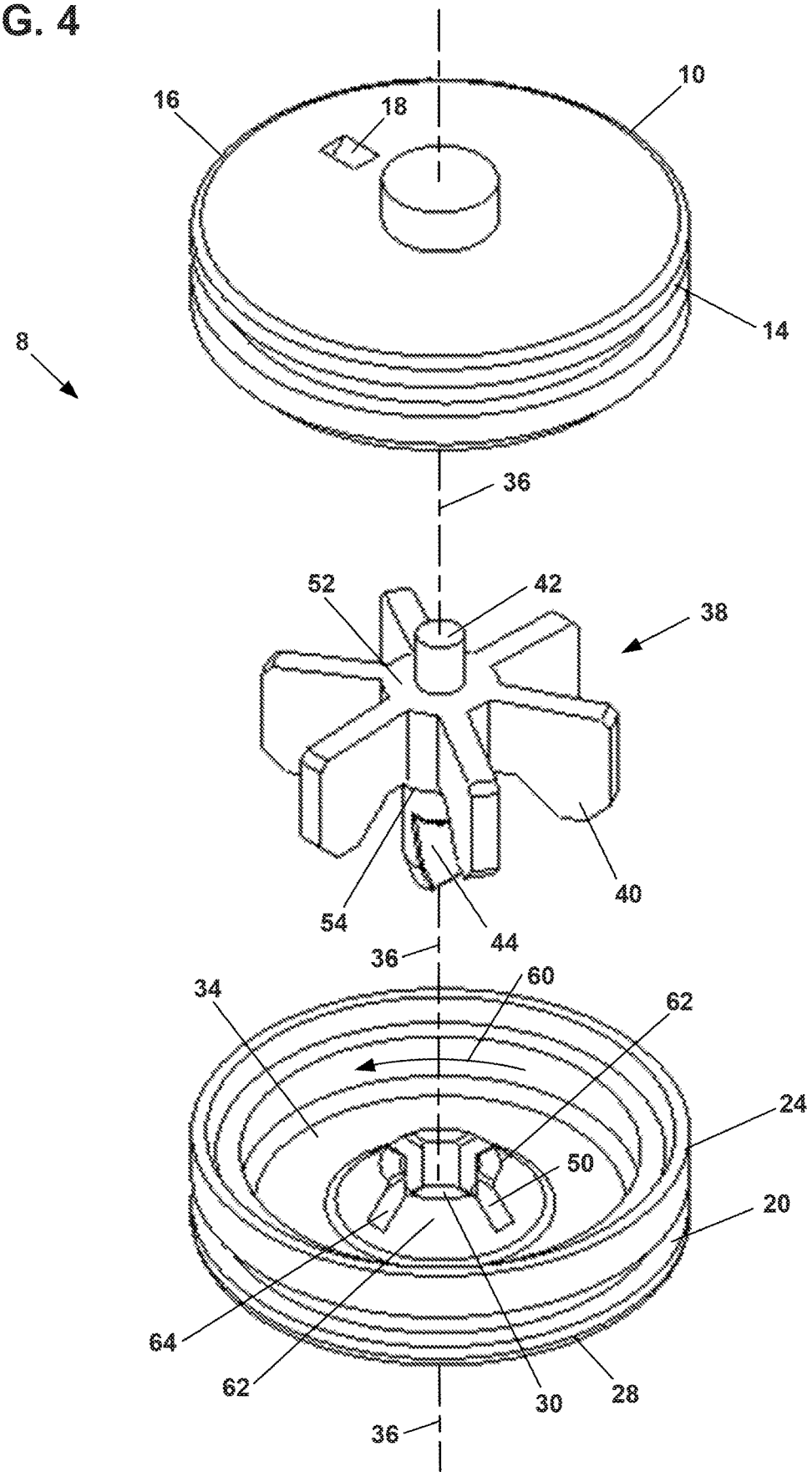
FIG. 4 shows an exploded view of the showerhead engine according to FIG. 1.

Moving on to FIG. 4, an exploded view of the showerhead engine 8 is shown, within the context of a showerhead 68. The first plate 10 is separated from the second plate 24 thereby exposing the wall 14 of the first plate 10 as well as the wall 20 of the second plate 24. Within the cavity 34, the swirling flow pattern 60 of the water is represented. As previously mentioned, water may be introduced into the cavity 34 through at least one hole 18 formed in the first plate 10. The hole 18 is formed at an angle other than normal to the surface of the first plate 10 thereby promoting the swirling flow pattern 60 as the water enters the cavity 34. Once the swirling flow pattern 60 is generated, the paddles 40 of the paddle wheel 38 are urged to rotate about the central axis 36 in the direction of the swirling flow pattern 60. The entire paddle wheel 38 is elevated off of the face surface 26 of the second plate 24 by the cone 62. The paddle wheel 38 also rotates about the central axis 36. The notched cutout 44 also rotates as it is formed into the central shaft 42. As the notched cutout 44 aligns with a slot 50, the water can flow out of the cavity 34 and through the passage 64 created by the alignment of the notched cutout 44 and the slot 50 in the through hole 30.

Figure 5:
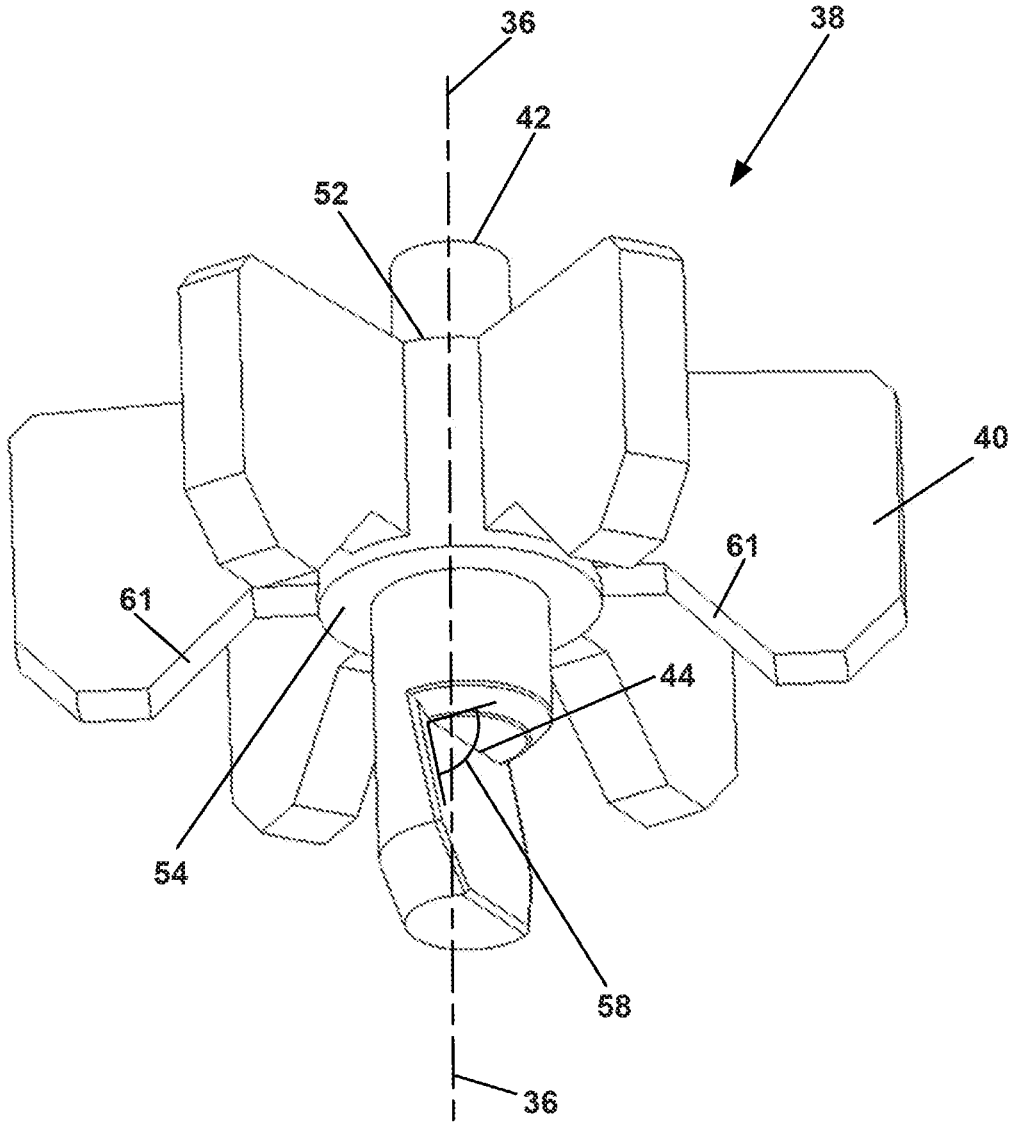
FIG. 5 shows a perspective view of a paddle wheel out of the showerhead engine as shown in FIG. 4.

Referring now to FIG. 5, an isolated view of the paddle wheel 38 is shown. The notched cutout 44 can be seen to be formed with an angled surface 58. The angled surface 58 allows the stream of water exiting the showerhead engine 8 to be fine-tuned. Different angles will produce different trajectories of exiting streams. Any angle, including an angled surface 58 parallel to the central axis 36 may be used.

Each individual paddle 40 of the paddle wheel 38 is shown to have a shape including a sloped surface 61. The sloped surface 61 is formed to compliment the profile of the cone 62, shown in FIG. 4. The sloped surface 61 ensures maximum surface area of the paddles 40 in contact with swirling water. The sloped surface 61 also allows the cone 62 to provide the slots 50 and create the passages 64 when the notched cutout 44 aligns with the slots 50 (see for example FIG. 4). The second shoulder 54 therefore rides on top of the cone 62 and the paddles 40 match the contour of the cone with sloped surfaces 61.

Figure 6:
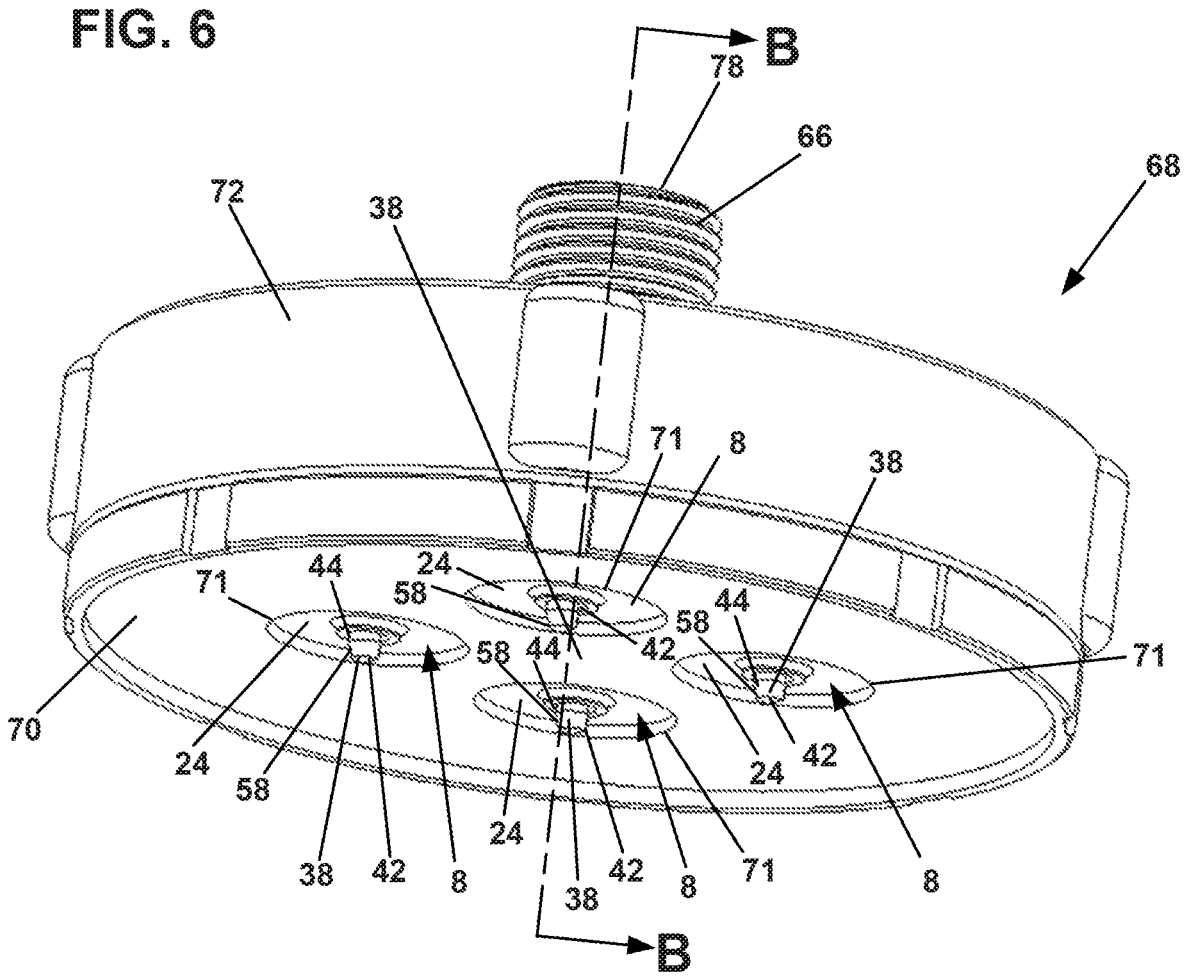
FIG. 6 shows a perspective view of a showerhead incorporating a plurality of the showerhead engines of FIG. 1.

The showerhead engine 8 may be used in any showerhead to provide a unique shower experience. In fact, multiple showerhead engines 8 may be installed into a single showerhead in any configuration. Each showerhead engine 8 may also be sized or scaled to suit the application. One example is shown in FIG. 6 where a showerhead 68 is shown incorporating four showerhead engines 8. Each showerhead engine 8 is shown protruding from openings 71 in the face 70 of the showerhead 68. The openings 71 are shown as circular and exposing the second plate 24, but the openings 71 may also be adjusted to be smaller and only expose the central shaft 42, or simply provide access to the water stream projected by the notched cutout 44 in the central shaft 42 of the paddle wheel 38.

The showerhead 68 includes a base 72 that is joined to the face 70. Water may be introduced into the inlet 78. The threaded collar 66 may be attached to the water source, such as a shower arm/elbow (not pictured), or any other water delivery device. The threaded collar 66 may also be modified to any known fastening device used to join plumbing fittings in the art.

Figure 7:
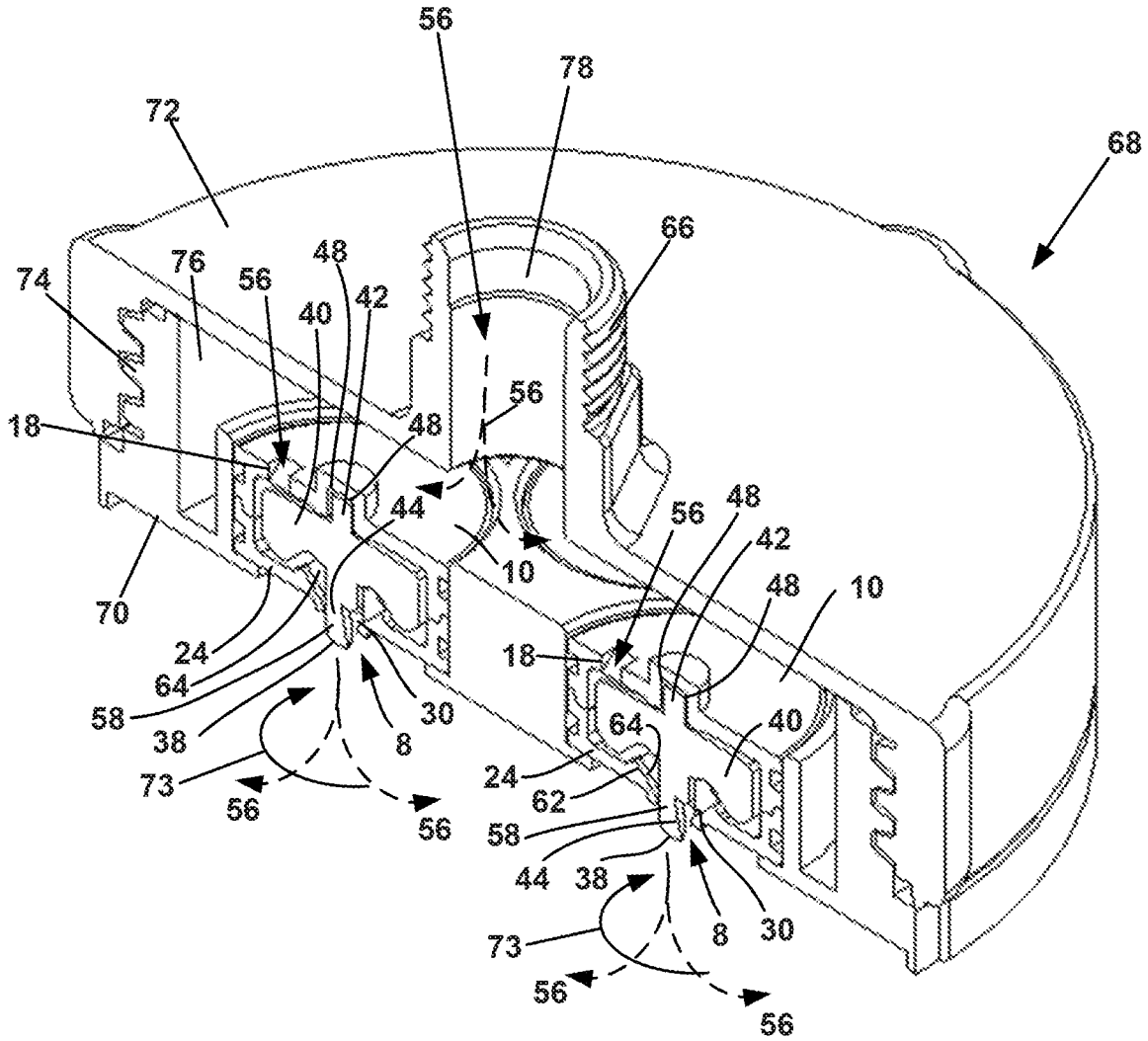
FIG. 7 shows a perspective, cross-sectional view of the showerhead of FIG. 6 along line BB.
Figure 8:
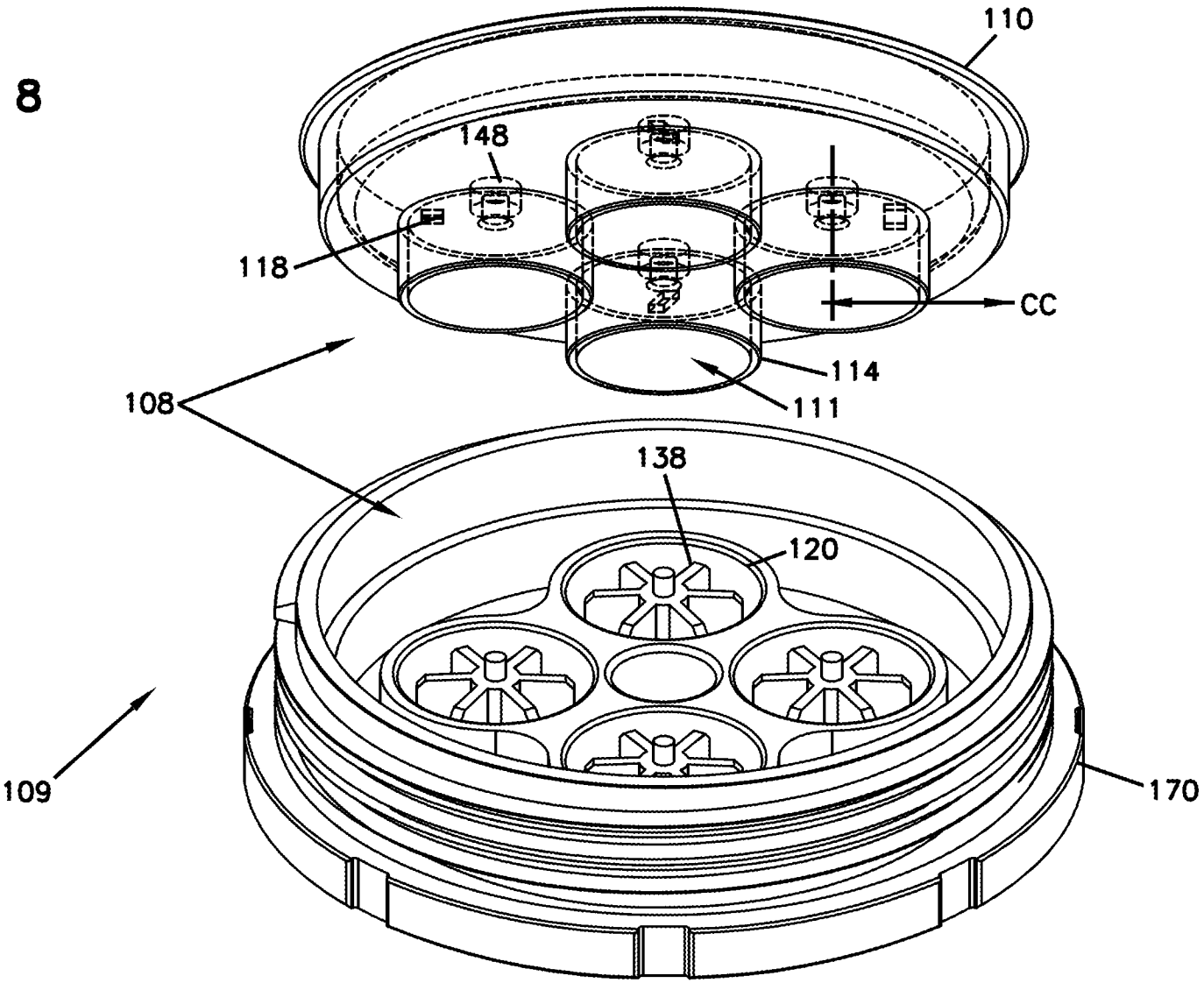
FIG. 8 shows a perspective exploded view of a showerhead engine assembly according to a second embodiment.
Figure 9:
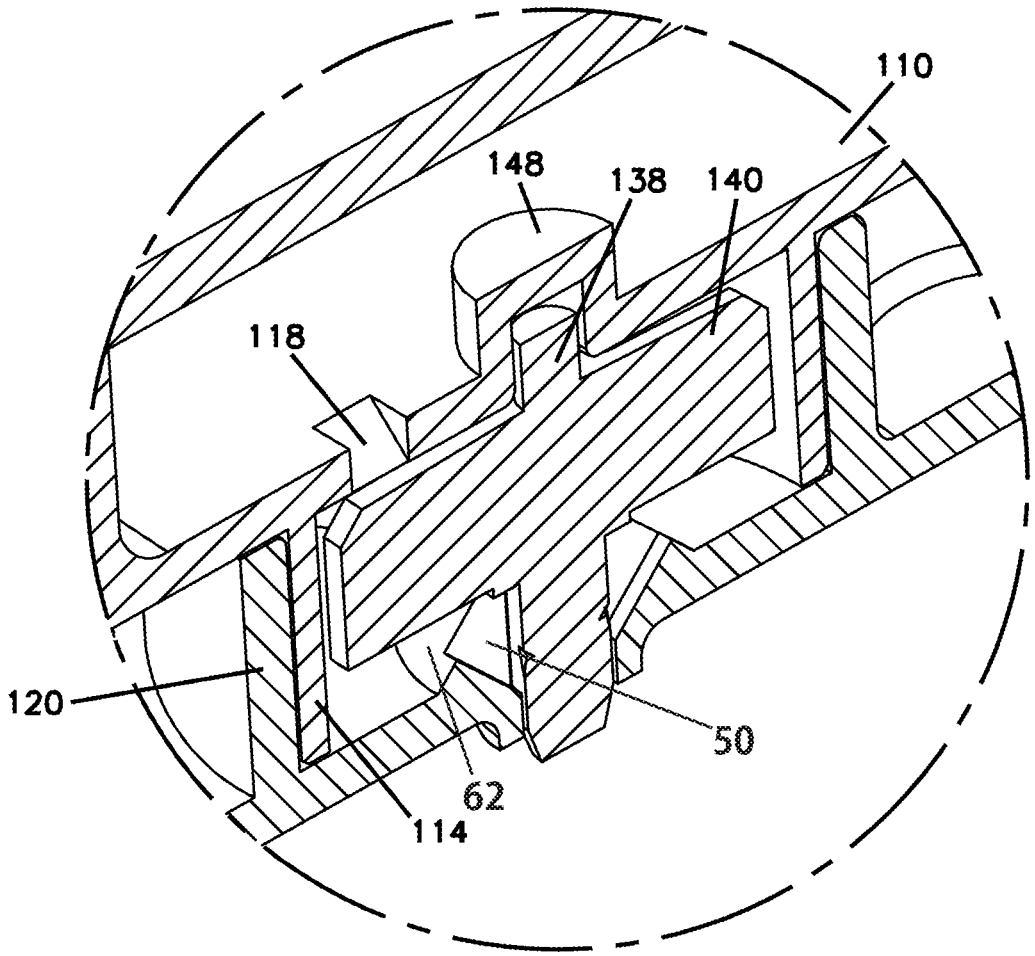
FIG. 9 shows a raised, perspective, cross-sectional view of a showerhead engine included in the showerhead engine assembly of FIG. 8 along line CC.
Figure 10:
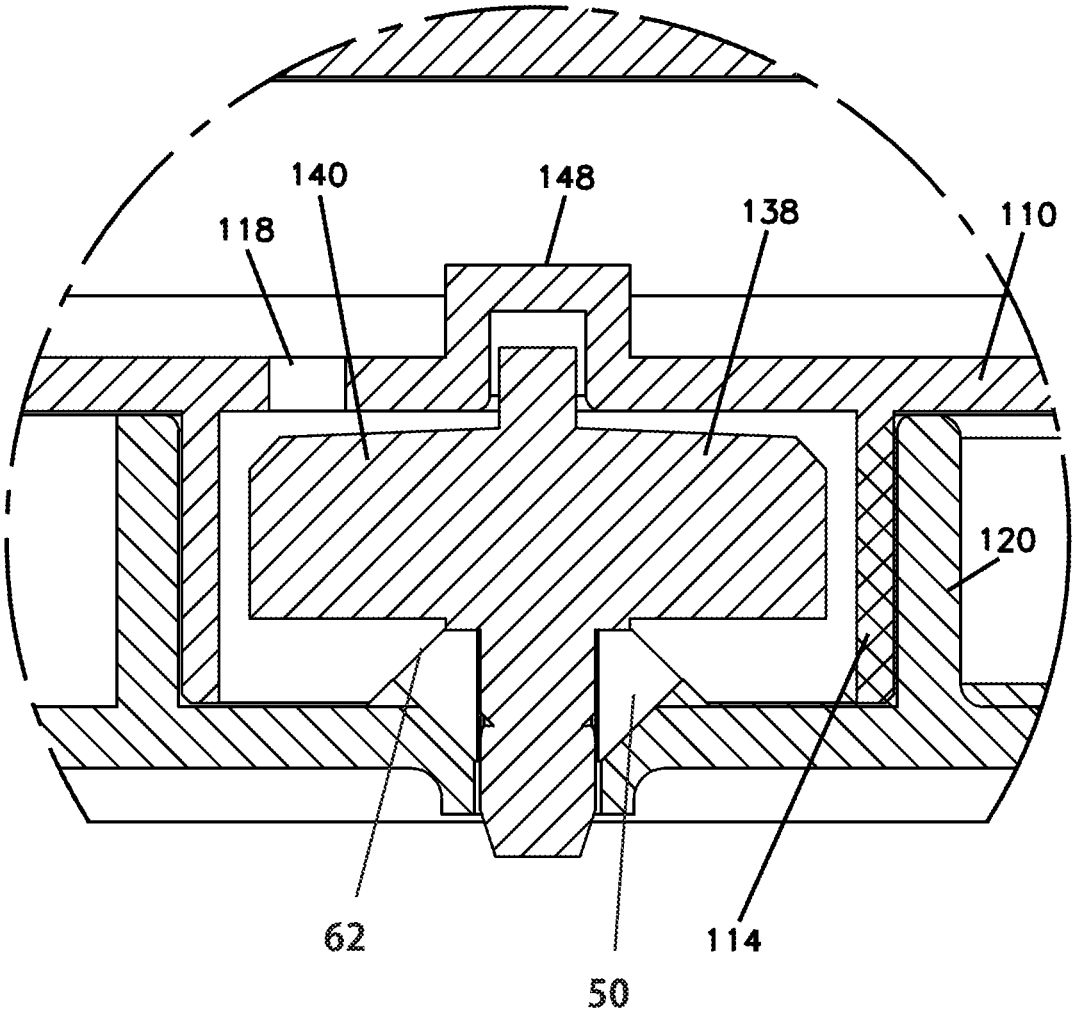
FIG. 10 shows a front, cross-sectional view of the showerhead engine included in the showerhead engine assembly of FIG. 8 along line CC.
Figure 11:
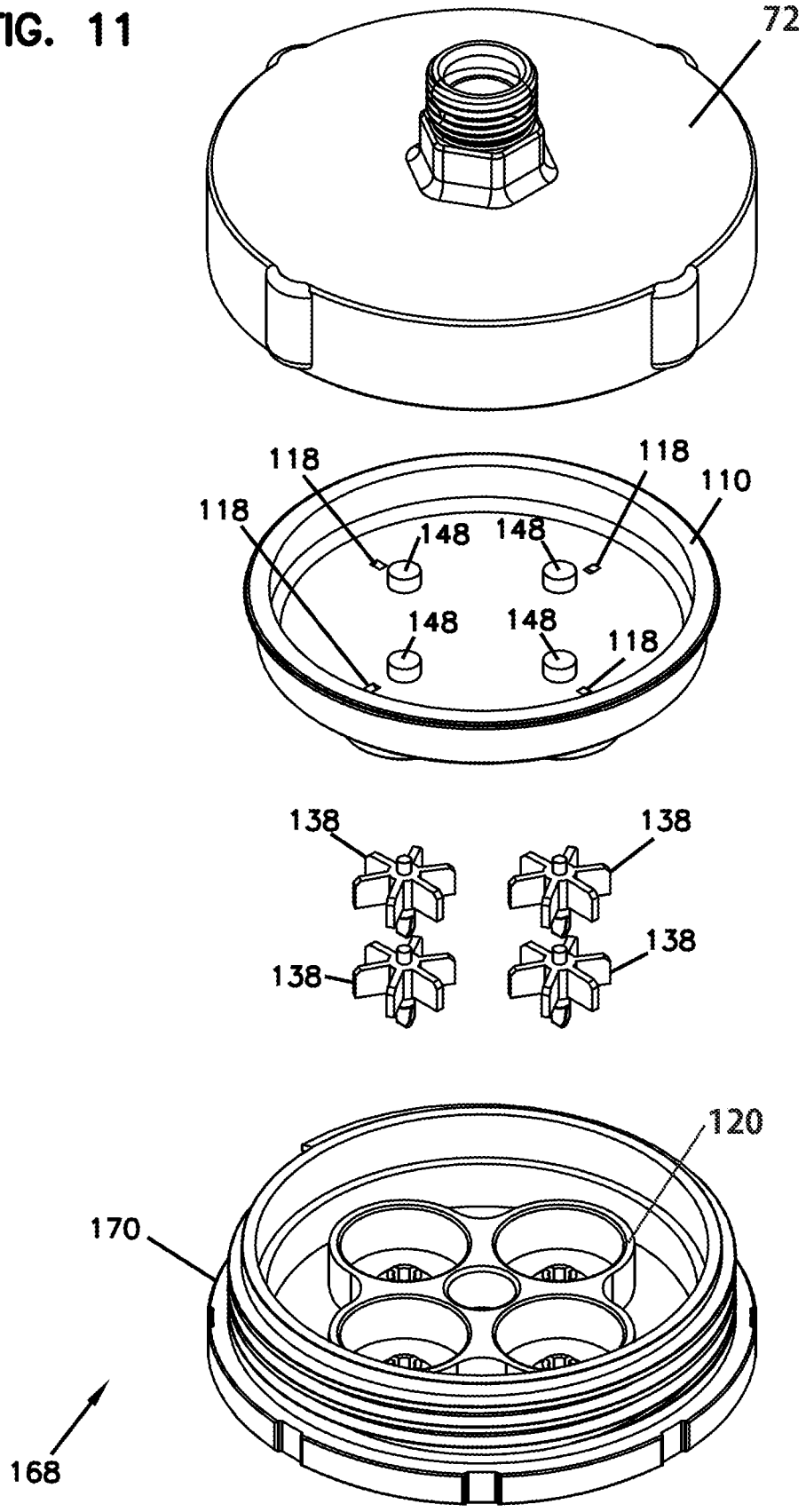
FIG. 11 shows an exploded view of a showerhead incorporating the showerhead engine of FIG. 8.
Figure 12:
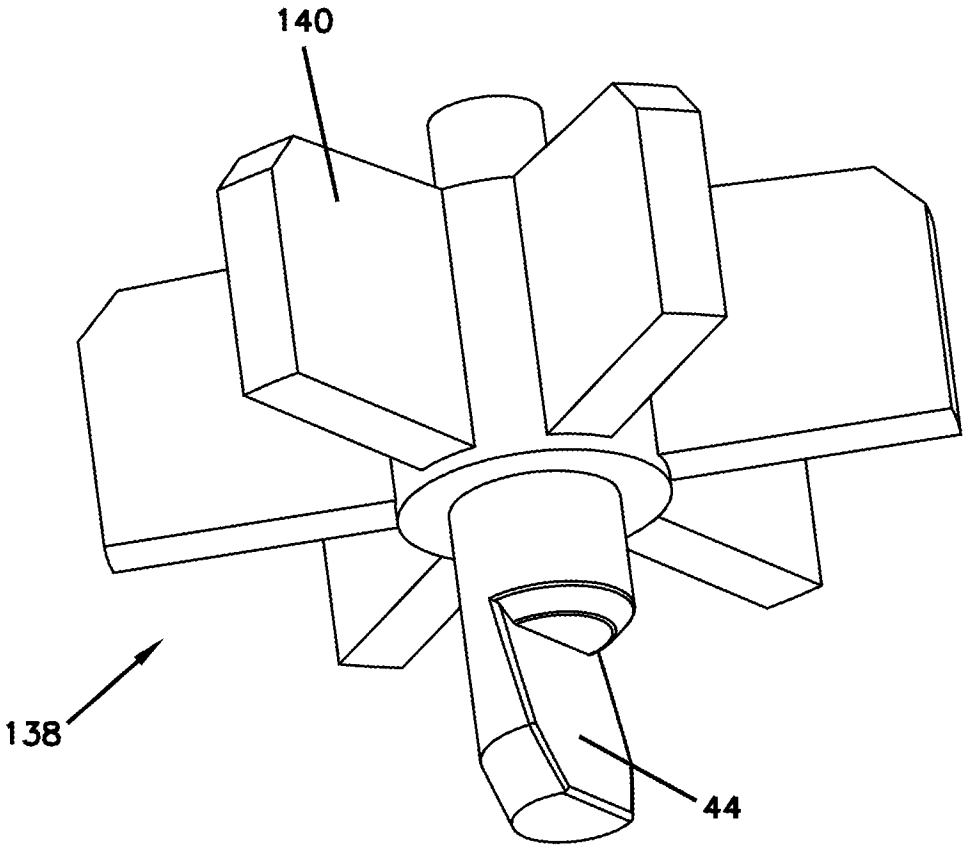
FIG. 12 shows a perspective view of a paddle wheel out of the showerhead engine as shown in FIG. 11.

Once water is introduced into the inlet 78, it flows into the showerhead 68 to feed the plurality of showerhead engines 8. As shown in FIG. 7, the inner workings of the showerhead 68 are shown. Again, the showerhead 68 shown is simply one embodiment of use of the showerhead engine 8. In some embodiments, the showerhead engine 8 is designed to be modular and operate in any showerhead that provides a compartment for the showerhead engine 8 to be fed water. As a result, the showerhead engine 8 may be used in a traditional, wall mounted showerhead 68 as shown, but may also be used as a "rain can" style showerhead, body spray, hand-held spray, or any other water delivery spraying device. In alternative embodiments, the showerhead engine 8 can be integrally formed into a showerhead, as is seen in FIG. 7.

In any application, the showerhead engine 8 should be fed water through an inlet 78. The water flow 56 is represented in FIG. 7 with a plurality of arrows. The base 72 and the face 70 of the showerhead 68 are shown joined by a threaded connection 74. Any known connection may be used to seal the two halves of the showerhead 68. The water flow 56 enters the inlet 78 and fills a reservoir 76 with water. The reservoir 76 provides a consistent source of water for each individual showerhead engine 8. The reservoir 76 feeds the holes 18 with a water flow 56 allowing the water flow 56 to enter the cavity 34 at an angle. As previously mentioned, each hole 18 is formed at an angle other than normal to the first plate 10. The angle of the hole 18 creates the swirling flow pattern 60 best shown in FIG. 4. One the water flow 56 is swirling in the cavity 34, the paddle wheel 38 is caused to rotate. As the notched cutout 44 of each paddle wheel 38 aligns with the slots 50 and create the passages 64, the water flow 56 sprays off of the angled surface 58 of the notched cutout 44. As the paddle wheel 38 rotates, different passages 64 are opened up allowing the water flow 56 to create a rotating stream depicted by rotation 73.

Referring now to FIGS. 8-14, a second example embodiment of a showerhead engine is shown, integrated into a showerhead 168. In this example embodiment, the showerhead 168 includes a showerhead engine assembly 109 integrally formed within the showerhead and forming a plurality of showerhead engines 108. The showerhead engine assembly 109 is formed from a backplate 110, a face 170 and a plurality of paddle wheels 138.

The backplate 110 includes a plurality of cylindrical walls 114 forming sidewalls of showerhead engines 108, as well as a plurality of holes 118 extending therethrough, and shaped analogously to holes 18 described above. The holes 118 extend through the backplate 110 into cavity areas 111 within the area formed by the cylindrical walls 114 such that, when the backplate 110 is joined to the face 170, shower engines 108 are formed. Backplate 110 includes recessed portions 148 positioned at respective central axes of the cylindrical walls 114, for receiving paddle wheels 138 in a manner similar to that of recessed portions 48, above.

In the embodiment shown, the face 170 includes a plurality of showerhead engine locations formed by second walls 120 extending therefrom in a direction of the backplate 110. In such an embodiment, the second surface, as it is described herein, can be formed in the face 170 directly, rather than requiring a separate second surface of a showerhead engine as above. Furthermore, the backplate 110 forms a plurality of first surfaces, in the manner described above, for each respective showerhead engine. The second walls 120 cooperate with the walls 114 to form cavity areas 111, as noted above, with each cavity area 111 having an associated paddle wheel 138.

Generally, the paddle wheels 138 correspond to paddle wheels 38 of FIGS. 1-7. However, in the example embodiments shown (seen particularly in FIGS. 9-10 and 12, each paddle 140 has a generally rectangular shape, allowing for some fluid flow along the paddle wheel in an area within the cavity area 111 that is proximate to the face 170. The paddle wheels 138 retain the notched cutout 44, promoting changing water flow as the paddles rotate within cavity areas 111.

Although in the embodiment shown the backplate 110 and face 170 cooperate to form four showerhead engines 108 from cavity areas and associated paddle wheels 138, more or fewer showerhead engines could alternatively be formed. Furthermore, the face 170 is otherwise formed analogously to the face 70 above, allowing protrusion of a portion of paddle wheels 138 including notched cutout 44.

As can be seen by comparing the embodiments of FIGS. 1-7 and 8-14, respectively, the first walls 14, 114 and second walls 20, 120 can be joined in different ways. In the example embodiment shown in FIGS. 8-14, the first wall is inserted within and adjacent to a perimeter formed by the second wall, with each of the first and second wall extending substantially the full distance between the backplate 110 and the face 170; in such an arrangement, the first and second walls can be affixed to each other to maintain the relative positions of the backplate 110 and cover 170. In alternative embodiments, the first wall can define an outer perimeter of a showerhead engine, with the second wall fitting within and adjacent to the first wall. In still further embodiments, such as seen in FIGS. 1-7, the first and second walls 14, 20 can be located at a common perimeter distance and have a common shape, with each extending from the first and second plates 10, 24, respectively and are affixed at a circular junction between the first and second plates 10, 24. Other embodiments are possible as well, in accordance with the present disclosure.

Figure 13:
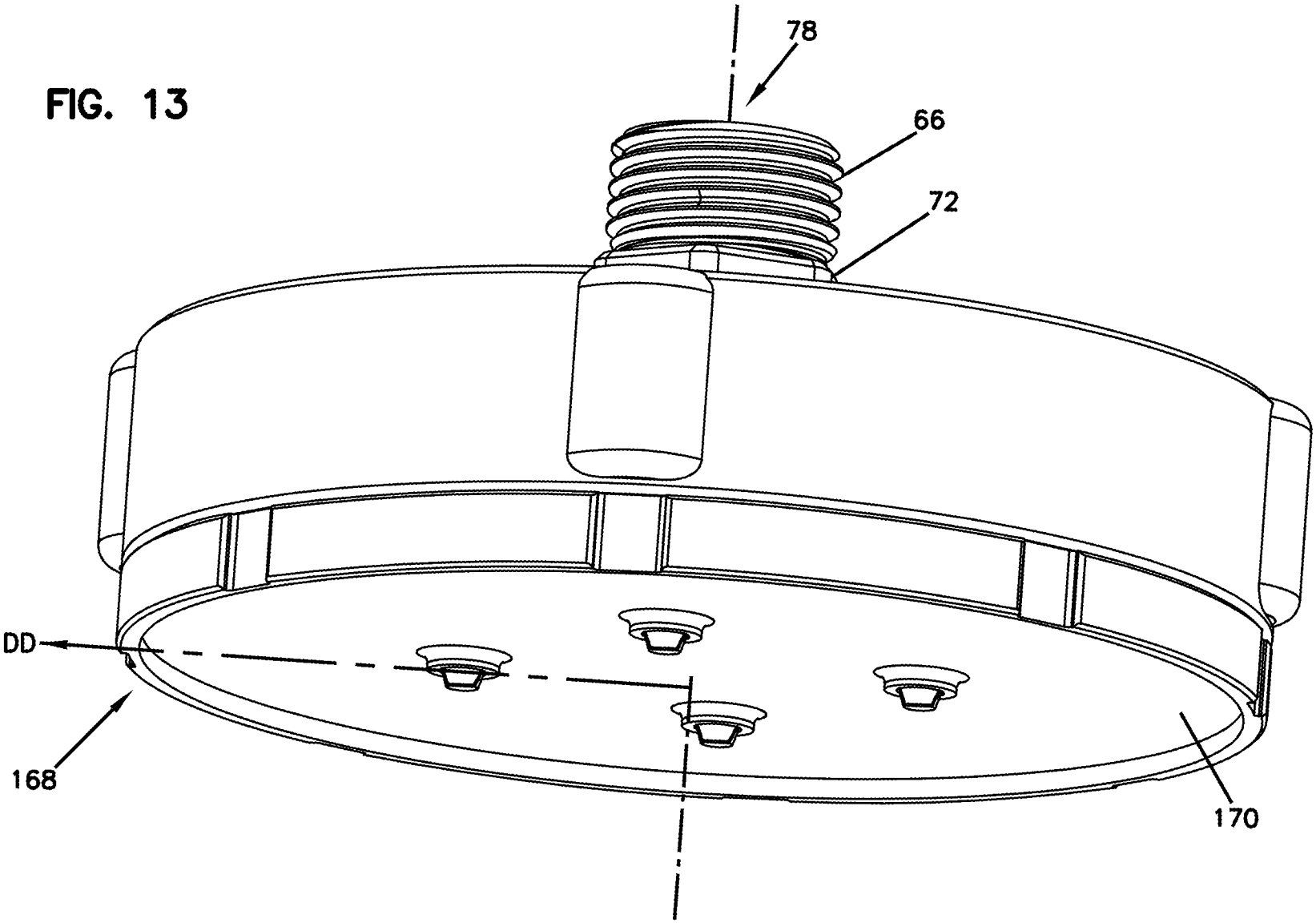
FIG. 13 shows a perspective view of a showerhead incorporating the showerhead engine assembly of FIG. 8.
Figure 14:
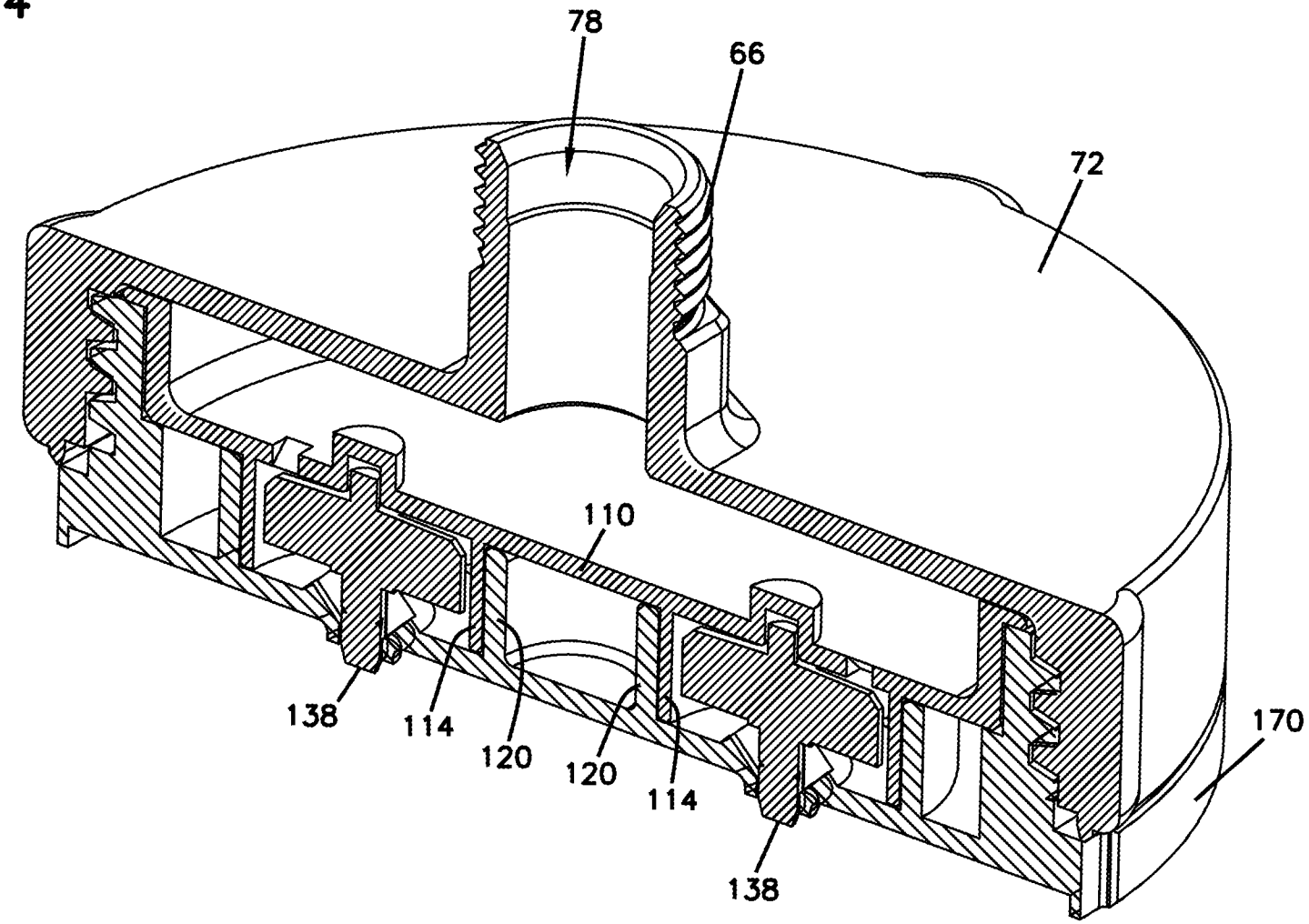
FIG. 14 shows a perspective, cross-sectional view of the showerhead of FIG. 13 along line DD.

Referring to FIGS. 13-14 specifically, it is noted that the showerhead 168 can be held together by complementary outward-facing threading of the face 170 with inward-oriented threading of a base 172. When threaded together, the face 170 and base 172 hold the backplate 110 and paddlewheels 130 in place. Additionally, an area between the backplate 110 and base 170 receives water flow in the manner described above, in connection with FIGS. 6-7.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

I claim:

1. A spray pattern device comprising:

a first plate;

a second plate connected to the first plate, the first and second plates defining a cavity therebetween;

an inlet hole defined in the first plate, the inlet hole being configured to allow water to enter the cavity;

an outlet hole defined in the second plate; and a paddle wheel positioned within the cavity and being rotatable with respect to the first and second plates, the paddle wheel having at least one paddle extending from a central shaft, the central shaft having a first end supported by the first plate and a second end extending at least partially through the outlet hole, the second end of the central shaft further including a notched cutout with an angled surface that is angled with respect to a central axis of the cavity, wherein the notched cutout extends past an exterior side of the outlet hole.

2. The spray pattern device of claim 1, further comprising a plurality of slots defined in the second plate and intersecting the outlet hole.

3. The spray pattern device of claim 2, wherein water flow is directed to flow through the plurality of slots when the notched cutout aligns with each slot as the notched cutout revolves.

4. The spray pattern device of claim 2, further comprising a cone extending into the cavity from the second plate, the cone surrounding the outlet hole, wherein the plurality of slots are defined by the cone.

5. The spray pattern device of claim 1, wherein the central shaft aligns with the central axis of the cavity, wherein the inlet hole is radially offset from the central axis.

6. The spray pattern device of claim 5, further comprising a recessed portion formed in the first plate at the central axis configured to receive the central shaft.

7. The spray pattern device of claim 1, wherein the first plate has a face surface, and wherein the inlet hole is defined in the face surface and the inlet hole includes at least one surface formed at an angle other than normal to the face surface.

8. The spray pattern device of claim 1, wherein the cavity is cylindrical and the paddle wheel includes a plurality of paddles that extend from the central shaft.

9. The spray pattern device of claim 8, wherein the plurality of paddles are perpendicular with respect to a face surface of the first plate and a second face surface of the second plate.

10. The spray pattern device of claim 1, wherein the central shaft of the paddle wheel includes a shoulder.

11. The spray pattern device of claim 1, wherein the angled surface is further configured to deflect water flow as the water exits the cavity via the outlet hole.

12. A spray pattern device comprising:

a first plate having a face surface;

a second plate connected to the first plate, the first and second plates defining a cavity therebetween;

an inlet hole defined in the face surface of the first plate, the inlet hole being configured to allow water to enter the cavity, the inlet hole including at least one surface formed at an angle other than normal to the face surface;

an outlet hole defined in the second plate; and a paddle wheel positioned within the cavity and being rotatable with respect to the first and second plates, the paddle wheel having at least one paddle extending from a central shaft, wherein the central shaft has a first end supported by the first plate, and a second end extending at least partially through the outlet hole, and wherein the central shaft aligns with a cavity central axis, wherein the inlet hole is radially offset from the cavity central axis, wherein the second end of the central shaft further includes a notched cutout with an angled surface that is angled with respect to the cavity central axis, wherein the notched cutout extends past an exterior side of the outlet hole.

13. The spray pattern device of claim 12, wherein the angled surface is further configured to deflect water flow as the water exits the cavity via the outlet hole.

14. The spray pattern device of claim 12, further comprising a recessed portion formed in the face surface of the first plate at the cavity central axis.

* * * * *